US006074600A

United States Patent [19]

Suer et al.

[11] Patent Number: 6,074,600

[45] Date of Patent: Jun. 13, 2000

[54] MODIFICATION OF TUNDISH DAM TO MINIMIZE TURBULENCE

[75] Inventors: Mark A. Suer, Cincinnati; Donald J. Wolf, Mansfield, both of Ohio

[73] Assignee: Armco Inc., Middletown, Ohio

[21] Appl. No.: 09/318,950

[22] Filed: May 26, 1999

[51] Int. Cl.[7] ..... C21B 7/14; C21B 3/00

[52] U.S. Cl. ..... 266/229; 266/275; 222/594

[58] Field of Search ..... 266/227, 229, 266/275; 222/594; 164/335, 337, 437

[56] References Cited

U.S. PATENT DOCUMENTS

| | | | |
|---|---|---|---|
| 4,671,499 | 6/1987 | Ishiyama et al. . | |
| 4,770,395 | 9/1988 | Thanh et al. | 266/275 |
| 4,776,570 | 10/1988 | Thanh et al. | 266/229 |
| 4,852,632 | 8/1989 | Jackson et al. . | |
| 4,995,592 | 2/1991 | Kegan et al. . | |
| 5,131,635 | 7/1992 | Soofi . | |
| 5,511,766 | 4/1996 | Vassilicos . | |

FOREIGN PATENT DOCUMENTS

| | | |
|---|---|---|
| 2 164 281 | 3/1986 | United Kingdom . |

*Primary Examiner*—Scott Kastler
*Attorney, Agent, or Firm*—L. A. Fillnow

[57] ABSTRACT

This invention relates to modifying the inside bottom surface of a tundish for continuous casting molten steel to minimize turbulence thereby reducing gas bubble and slag entrainment during continuous casting of steel, especially when initially filling of the tundish. Turbulence mitigation tends to avoid entrapment of oxide inclusions in a cast slab. This invention is for an elongated tundish (10) including a pair of spaced refractory lined side walls (12) disposed in a longitudinal direction, a pair of spaced refractory lined end walls (14) extending in a lateral direction between the side walls, a refractory lined floor (16), a molten metal impact pad (18) and a molten steel outlet (20). A refractory lined weir (26) is positioned between the impact pad and the steel outlet. A refractory ramp (34) is positioned between the weir and the steel outlet. The ramp is mounted to the floor and extends the full width of the floor in the lateral direction contacting each of the side walls. The ramp has first and second surfaces with a first surface (40) adjacent the outlet and inclined downwardly at an angle of 20–50° and a second surface (42) facing the weir having a substantially vertical face. Liquid steel cleanliness is improved and submerged entry nozzle clogging is reduced.

20 Claims, 3 Drawing Sheets

MODIFICATION OF TUNDISH DAM TO MINIMIZE TURBULENCE

BACKGROUND OF THE INVENTION

This invention relates to modifying the inside bottom surface of a continuous casting tundish to mitigate molten metal turbulence thereby improving metal cleanliness. The invention includes an elongated tundish having a refractory ramp extending in a lateral direction and mounted to the inside bottom surface of the tundish. The ramp has first and second surfaces with the first surface inclined downwardly in a direction toward a tundish outlet and the second surface having a substantially vertical face. Inclusions caused by entrained gas bubbles and slag in a continuously cast slab, especially steel slabs, are reduced.

It is known to modify the inside bottom surface of a tundish to include means for reducing turbulence, gas bubble entrainment, slag entrainment and removing oxide inclusions from molten metal during continuous casting. For example, it is known to mount one or more dams to the inside bottom surface of a tundish with the dams extending in a transverse direction relative to molten metal flow through the tundish. These dams extend upwardly from the bottom of the tundish. It also is known to mount one or more weirs or baffles within the inside of a tundish with the weirs or baffles extending in a transverse direction relative to the molten metal flow through the tundish. These weirs or baffles are attached to the spaced side walls forming the tundish and extend vertically downwardly from the top of the tundish to a point a short distance above the inside bottom of the tundish. Metal turbulence is mitigated and gas bubbles and oxide inclusions may be removed to liquid slag floating on the upper surface of the molten metal as the molten metal flows along a tortuous path along the bottom of the tundish over the tops of dams and/or under the weirs while flowing from a ladle through the tundish to a casting mold. Typical weirs and dams are illustrated in U.S. Pat. No. 4,671,499. It also is known to pass molten metal through porous ceramic filters for removing oxide inclusions. U.S. Pat. No. 5,511,766 illustrates the use of dams and baffles having porous refractory filtering elements for removing inclusions as molten metal passes through a tundish.

It also is known to modify the bottom of a tundish to include an upwardly inclined surface or ramp to elevate molten metal flow within a tundish. U.S. Pat. No. 5,131,635 discloses a tundish impact pad having rising flow channels for reducing turbulence and impurities. This patent illustrates ramp-like flow channels that are inclined upwardly causing molten steel to rise as the steel flows through the tundish toward an exit port. British patent 2,164,281 relates to an inside surface of a tundish bottom modified to include a replaceable porous gas injection tile for separating inclusions. The tile encapsulates an inert gas conduit extending between each of the spaced sides of the tundish. The tile includes a porous ramp-like downwardly inclined surface for deflecting molten metal upwardly in a direction toward an exit port within the tundish.

Significant improvements have been made over the years in continuous casting tundish design for minimizing metal turbulence and improving metal cleanliness. Nevertheless, there remains a need for an improved tundish design because oxide clogging of a submerged entry nozzle continues to be a problem, especially reoxidation of the molten metal during the initial filling of a newly relined tundish. As a relined tundish is being filled, molten steel cascades over dams, resulting in significant reoxidation and gas bubble/slag entrainment. This amount of reoxidation at the beginning of a cast can cause clogging in the submerged entry nozzle during steady state continuous casting.

BRIEF SUMMARY OF THE INVENTION

This invention relates to modifying the inside bottom surface of a tundish for continuous casting molten metal for mitigating molten metal turbulence, reducing air and slag entrainment to improve metal cleanliness.

A principal object of the invention is to reduce gas bubble and slag entrainment by reducing turbulence during initial filling of a continuous casting tundish.

Another object of the invention is to prevent entrapment of inclusions within molten metal during initial filling of a continuous casting tundish.

Another object of the invention is to reduce submerged entry nozzle clogging during steady state continuous casting.

Another object of the invention is to reduce gas bubble and slag entrainment by reducing turbulence during steady state continuous casting.

Another object of the invention is improve the surface quality of continuously cast metal slabs.

The invention is an elongated tundish including a pair of spaced side walls disposed in a longitudinal direction, a pair of spaced end walls extending in a lateral direction between the side walls, a floor, a molten metal outlet and a ramp attached to the floor extending in the lateral direction. The ramp has first and second surfaces with the first surface being adjacent to the outlet and inclined downwardly and the second surface having a substantially vertical face.

Another feature of this invention is for the aforesaid first surface being inclined at an angle of 30–45°.

Another feature of this invention is for the aforesaid floor to include a weir with the ramp being positioned between the weir and the outlet.

Another feature of this invention is for the aforesaid ramp to extend completely across the floor and engaging the inside surface of each of the side walls.

Another feature of this invention is for the aforesaid floor to include a second ramp mounted thereto and including a downwardly inclined face extending in a direction toward the weir.

Advantages of this invention include minimal molten metal turbulence within the tundish, minimal gas bubble and slag entrainment within cast molten metal and fewer inclusions being trapped within cast slab. This results in reduced submerged entry nozzle clogging and improved surface quality of continuously cast slabs, especially during initial stages of continuous casting. Reduced submerged entry nozzle clogging increases cast slab yield by reducing the size of tundish skulls while improved metal slab cleanliness improves in-processing sheet yields because of fewer sheet surface defects.

The above and other objects, features and advantages of the invention will become apparent upon consideration of the detailed description and appended drawings.

DETAILED DESCRIPTION OF THE PREFERRED EMBODIMENT

Metal turbulence can cause gas bubbles or pockets, e.g., air, hydrogen, argon, and oxide inclusions to become entrapped within the molten metal and pass into the casting mold forming defects within a cast slab. These high melting point refractory oxides also tend to stick to the molten metal outlet and cause clogging of a submerged entry nozzle (SEN). This clogging can cause the casting process to be aborted, cause skulls to be formed within the tundish, cause rejection of defective cast slabs, cause excessive cooling of the molten metal thereby requiring retreating and otherwise disrupt the casting process.

By molten metal in this invention, it will be understood to include ferrous and nonferrous metals including but not limited by stainless steel, electrical steel, low carbon steel, titanium, copper, aluminum and alloys thereof.

Figure 1:
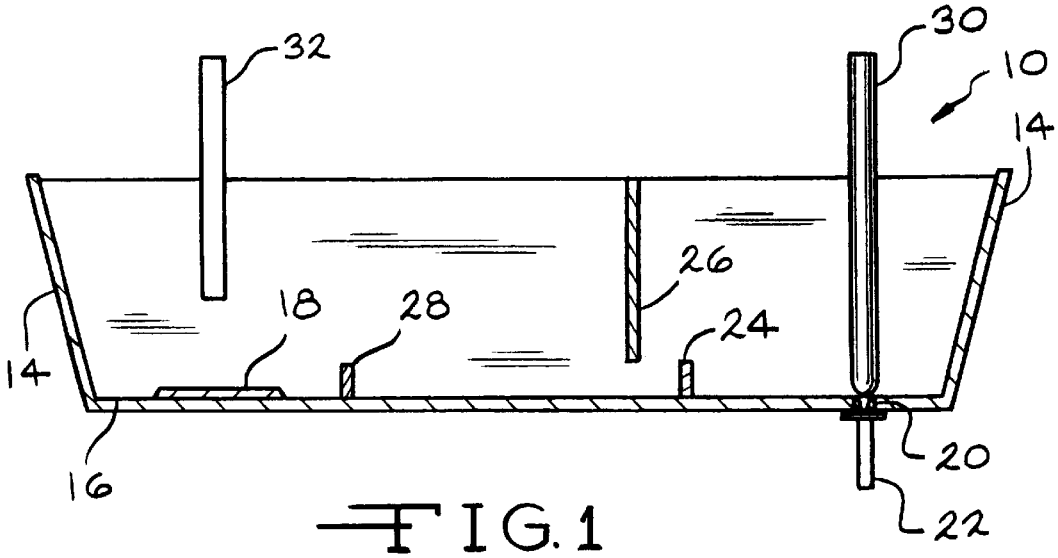
FIG. 1 PRIOR ART
FIG. 1 is an elevation section view taken along line 1—1 of FIG. 2 of a prior art tundish for holding molten metal.
Figure 2:
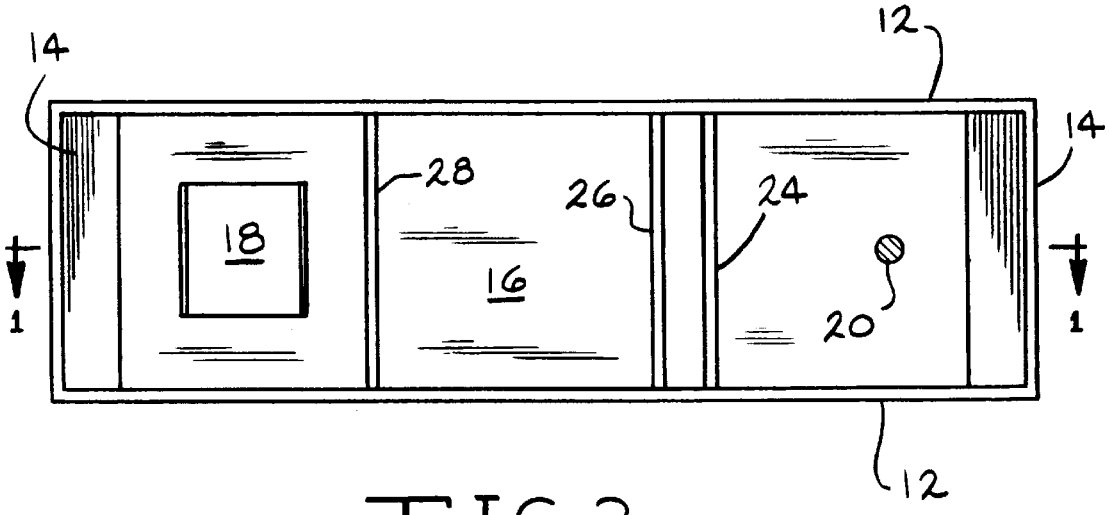
FIG. 2 PRIOR ART
FIG. 2 is a plan view of the prior art tundish of FIG. 1.

Referring to FIGS. 1 and 2, reference numeral 10 denotes a prior art refractory lined tundish for holding molten metal. The tundish includes a pair of spaced refractory lined longitudinally extending side walls 12, a pair of laterally spaced inclined refractory lined end walls 14 positioned between and at the ends of side walls 12, a floor 16, a molten metal impact pad 18, a molten metal outlet 20, a refractory SEN 22 for flowing molten metal into a continuous casting mold (not shown), a stopper rod 30 for regulating the flow of molten metal through outlet 20 into the casting mold and a shroud 32 containing a non-oxidizing gas for protecting molten metal when the metal is transferred from a transfer ladle (not shown) to the tundish. The tundish may include means for turbulence minimization such as one or more of a dam 24 positioned adjacent to outlet 20, a weir 26 positioned upstream toward the entry end of the tundish and a dam 28 positioned further upstream adjacent to the impact pad.

Figure 3:
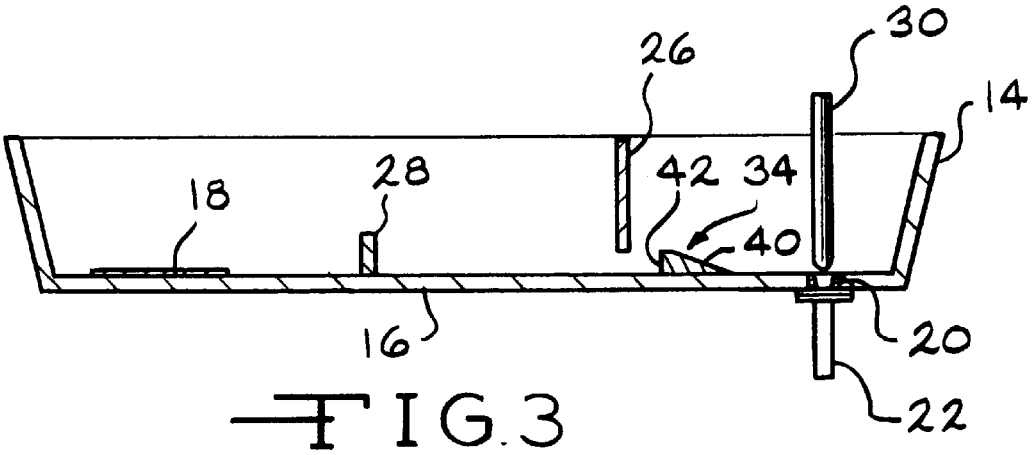
FIG. 3 is an elevation view of one embodiment illustrating a tundish ramp of the invention for holding molten metal.
Figure 4:
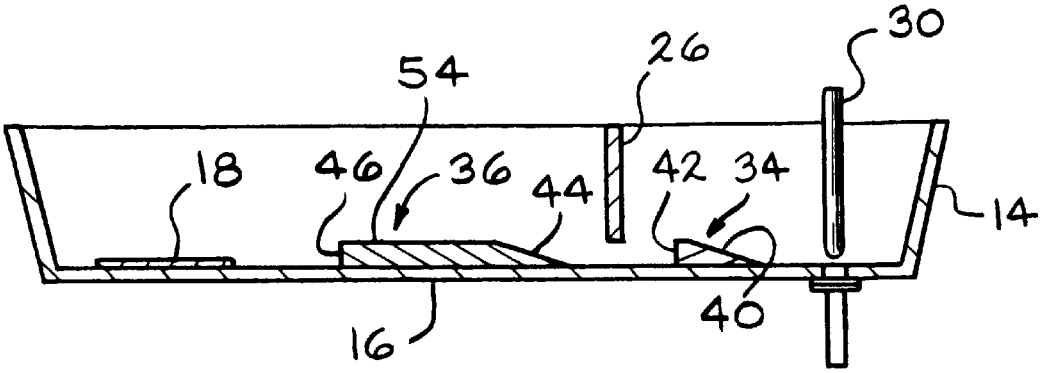
FIG. 4 is an elevation view of another embodiment illustrating two tundish ramps of the invention for holding molten metal.
Figure 5:
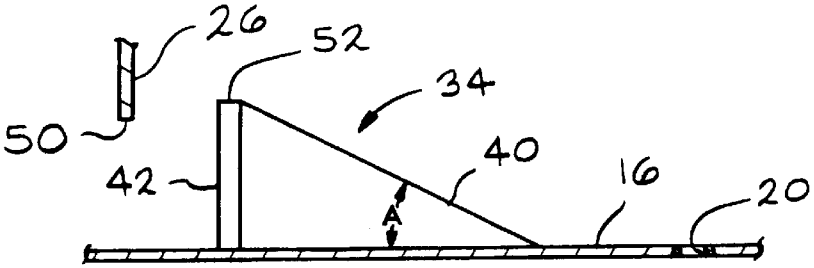
FIG. 5 is an enlarged partial detailed elevation view illustrating the ramp of the tundish of FIG. 3.

FIGS. 3 and 5 illustrate an elevation section view of one embodiment of a tundish of this invention for holding molten metal including an improved means for minimizing molten metal turbulence during continuous casting, especially during initial filling of the tundish. Those structural components included in FIGS. 1 and 2 which form part of the invention illustrated in FIGS. 3–6 have like numerals. This turbulence minimization means includes a refractory ramp 34 mounted to tundish floor 16. Ramp 34 is disposed between impact area 18 and outlet 20 and extends in a lateral direction, preferably across the entire floor width contacting longitudinally extending side walls 12. Ramp 34 includes a first surface 40 adjacent the outlet and inclined downwardly and a second surface 42 facing the impact area with this second surface extending in a substantially vertical direction. During metal casting, molten metal is redirected abruptly upwardly when contacting vertical surface 42 enabling inclusions, e.g., gas bubbles, aluminum oxides, calcium aluminates, silicates, titanium oxides, slag, having an opportunity to pass to liquid synthetic slag covering the molten metal. If surface 42 is oblique rather than vertical, excessive wear to the refractory surface would occur. If surface 42 is inclined upwardly, we determined that the molten metal tends to flow horizontally toward the outlet. Accordingly, a feature of this invention is for surface 42 to preferably be substantially vertical to cause molten metal to flow upwardly toward the covering slag layer thereby increasing the likelihood that inclusions are separated from the molten metal. A critical feature of this invention is for surface 40 to be inclined downwardly sufficiently to minimize gas and slag entrainment of the molten metal, especially during initial filling of the tundish, thereby minimizing subsequent passage of these inclusions through outlet 20 into the casting mold. Surface 40 must be inclined downwardly at an angle A of at least 20° relative to floor 16, preferably 20–45°, more preferably 25–35° and most preferably an angle of 30°. If angle 40 is inclined downwardly too abruptly at an angle A of much greater than 50°, we have determined that gas and slag entrainment are not markedly reduced. If surface 40 is inclined downwardly at an angle A less than about 20°, ramp 34 would become too long relative to the tundish length.

By modifying a tundish to include a ramp of this invention, we determined that the degree of removal of gas and oxide inclusions during continuous casting was increased over that of the prior art tundish illustrated in FIG. 1. We determined using a ramp of this invention was especially beneficial during the initial filling of the tundish prior to reaching steady state continuous casting. At the start of a casting run, no molten metal is present in the tundish. During the initial filling of the tundish, splashing of the molten metal is especially turbulent causing gas, oxide inclusions and slag likely to be passed through the tundish and become trapped in the first slab of the cast. The ramp of this invention will mitigate casting start-up problems.

Figure 6:
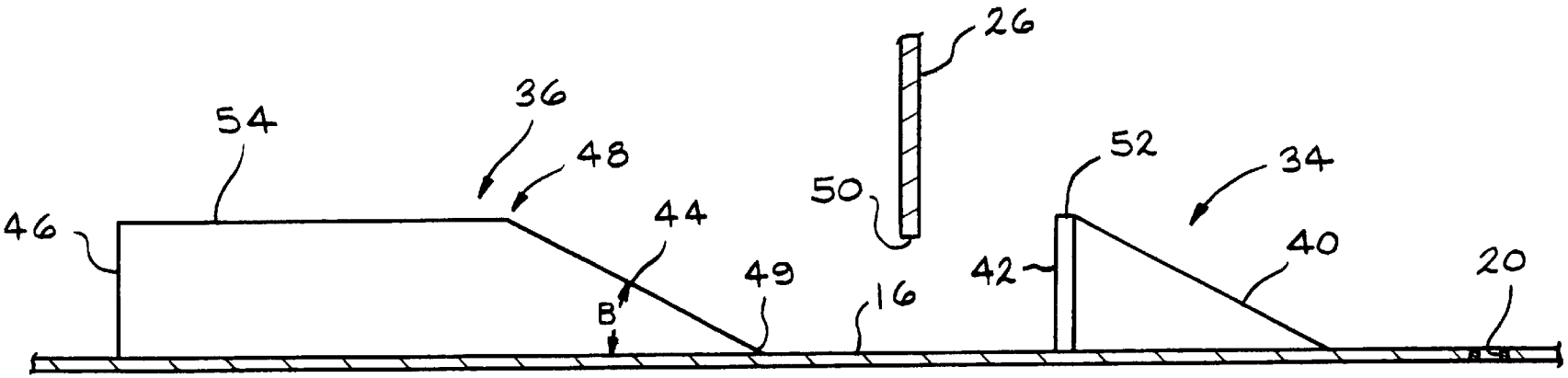
FIG. 6 is an enlarged partial detailed elevation view illustrating the ramps of the tundish of FIG. 4.

FIGS. 4 and 6 illustrate a preferred embodiment of an elevation view of a tundish of the invention for holding molten metal including an improved means for minimizing turbulence, i.e., reducing gas and slag entrainment, during continuous casting. The turbulence minimization means includes refractory ramp 34 illustrated in FIGS. 3 and 5 and a second refractory ramp 36 disposed between impact area 18 and weir 26. Ramp 36 includes a first surface 44 adjacent weir 26 and being inclined downwardly, a second surface 46 adjacent impact area 18 and being substantially vertical and a third substantially flat surface 54. Vertical surface 46 of ramp 36 removes gas bubbles and oxide inclusions from molten metal in much the same manner as vertical surface 42 of ramp 34 by causing molten metal to flow upwardly from impact area 18 with inclined surface 44 then redirecting molten metal flow downwardly and under the bottom of weir 26 toward vertical surface 42 of ramp 34. Surface 44 of ramp 36 is inclined downwardly at an angle B similar to that of angle A for surface 40 of ramp 34. By modifying a tundish to include a pair of ramps acting in concert, we determined that the degree of gas bubble and oxide entrainment during continuous casting, especially during the initial filling of the tundish, was significantly decreased over that of the prior art tundish illustrated in FIGS. 1 and 2.

EXAMPLE 1

An example demonstrating the invention now will be described. A tundish similar to that illustrated in FIG. 3 was built and tested using a laboratory water modeling technique. The tundish included a pair of spaced longitudinally extending side walls 12 having a length of 4.0 m, a pair of laterally spaced side longitudinal walls 12, weir 26 spaced between side walls 12 and positioned 16.5 cm above floor 16 and 188 cm away from impact pad 18. The tundish included ramp 34 having first surface 40 inclined downwardly at angle A of 30° and vertical surface 42 having a height of 18.0 cm. That is, upper surface 52 of ramp 34 preferably was elevated 1.5 cm above a lower surface 50 of weir 26. Surface 42 should be positioned at least 15.0 cm away from weir 26 and at least 60.0 cm away from outlet 20. That is, surface 42 is positioned at least twice as far away from outlet 20 as it is from weir 26 and preferably surface 42 is positioned at least three times as far away from outlet 20 as it is from weir 26 to cause molten metal to flow upwardly toward the covering slag layer thereby increasing the likelihood that inclusions are separated from the metal. In this example, surface 42 was positioned 23.0 cm away from weir 26 and 79.0 cm away from outlet 20. The longitudinal length of ramp 34 was 31.0 cm. That is, the lowermost portion of inclined surface 40 is positioned 48 cm away from outlet 20. It is important the longitudinal length of ramp 34 at least equal the distance that surface 42 is positioned away from weir 26 and that ramp 34 preferably be positioned farther away from outlet 20 than from weir 26. In this example, the overall length of ramp 34 exceeds by more than 10%, preferably by at least 20%, the distance that surface 42 is positioned away from weir 26. The tundish was observed as it was being filled with water with a video camera used to document the event. After rising within the tundish and above surface 52, the water flow was redirected downwardly along inclined surface 40. Significantly fewer bubbles were observed in the water flow when using the ramp illustrated in FIG. 3 then in a similar experiment when comparing to the tundish arrangement illustrated in FIG. 1. Less bubbles in the water flow model using this invention indicate fewer gas bubbles and slag entrainment would occur during filling of a tundish with molten steel.

The elevation of upper surface 52 of ramp 34 was elevated at least 1 cm above the elevation of lower surface 50 of weir 26. It is believed to be important for surface 52 to be above surface 50 so that fluid flow may be redirected toward the top of the tundish to facilitate inclusion removal during steady state casting.

EXAMPLE 2

In another example demonstrating this invention, a tundish as illustrated in FIG. 4 was built and tested using the laboratory water model. This tundish was identical to that described above in Example 1 except as follows. This tundish included a second ramp 36 having first surface 44 inclined downwardly at an angle B of 30°, vertical surface 46 having an elevation of 18.0 cm above floor 16 and a flat surface 54 extending a longitudinal length of 61.0 cm. Edge 48, i.e., the intersection 48 of inclined surface 44 and horizontal surface 54, was positioned 30 cm away from weir 26 and a lowermost portion 49 of inclined surface 44 was positioned 18.0 cm away from weir 26. The tundish was observed as it was being filled with water using a video camera. After rising within the tundish and above surface 54 of ramp 36, the water flow was redirected downwardly along inclined surface 44, under surface 50 of weir 26, toward vertical surface 42 of ramp 34 and then upwardly again within the tundish before being redirected downwardly along inclined surface 40. Significantly fewer bubbles were observed in the water flow when using the two ramps operating in concert illustrated in FIG. 4 then in a similar experiment when comparing to the prior art tundish arrangement illustrated in FIGS. 1 and 2. Fewer bubbles in the water flow model using this invention indicates fewer gas bubbles and less slag entrainment would occur during filling of a tundish using molten steel.

It will be understood various modifications may be made to the invention without departing from the spirit and scope of it. Therefore, the limits of the invention should be determined from the appended claims.

What is claimed is:

1. An elongated tundish for continuous casting molten metal, comprising:

an elongated tundish including a pair of spaced side walls disposed in a longitudinal direction and a pair of spaced end walls extending in a lateral direction between the side walls and a floor, the floor including a molten metal impact area, a molten metal outlet, a weir between the impact area and outlet, and first and second ramps, each having first and second surfaces, the first ramp positioned between the weir and the outlet while extending in the lateral direction, the first surface adjacent the outlet and inclined downwardly, the second surface facing the weir and being substantially vertical, the second ramp positioned between the weir and the impact area while extending in the lateral direction, the first surface adjacent the weir and inclined downwardly, the second surface facing the impact area and being substantially vertical, whereby the substantially vertical second surfaces cause molten metal to flow in a direction generally upwardly from the impact area and toward the outlet thereby minimizing entrainment of gas bubbles and slag within molten metal.

2. The tundish of claim 1 wherein the downward slope of each of the first surfaces is an angle of 20–50°.

3. The tundish of claim 2 wherein the downward slope is an angle of 30–40°.

4. The tundish of claim 1 wherein the second ramp includes a horizontal surface extending between the substantially vertical second surface and the inclined first surface.

5. The tundish of claim 1 wherein the lowermost elevation of the weir is below the uppermost elevation of the first ramp.

6. The tundish of claim 4 wherein the lowermost elevation of the weir is below the horizontal surface of the second ramp.

7. The tundish of claim 1 wherein the first ramp extends completely across the floor and engages each of the side walls.

8. The tundish of claim 1 wherein the second ramp extends completely across the floor and engages each of the side walls.

9. The tundish of claim 1 wherein the substantially vertical second surface of the first ramp is positioned at least twice as far away from the outlet as the substantially vertical second surface of the first ramp is positioned away from the weir.

10. The tundish of claim 1 wherein the longitudinal length of the first ramp is at least equal to the distance the substantially vertical second surface of the first ramp is positioned away from the weir.

11. An elongated tundish for continuous casting molten metal, comprising:

an elongated tundish including a pair of spaced side walls disposed in a longitudinal direction and a pair of spaced end walls extending in a lateral direction between the side walls and a floor, the floor including a molten metal impact area, a molten metal outlet, a ramp having first and second surfaces and a weir positioned between the ramp and the impact area, the ramp extending in the lateral direction and contacting each of the side walls, the lowermost elevation of the weir below the uppermost elevation of the ramp, the first surface adjacent the outlet and being inclined downwardly at an angle of 20–50°, the second surface adjacent the impact area and being substantially vertical whereby the surfaces cause molten metal to flow in a direction generally upwardly from the impact area and toward the outlet thereby minimizing entrainment of gas bubbles and slag within molten metal.

12. An elongated tundish for continuous casting molten metal, comprising:

an elongated tundish including a pair of spaced side walls disposed in a longitudinal direction and a pair of spaced end walls extending in a lateral direction between the side walls and a floor, the floor including a molten metal impact area, a molten metal outlet, first and second ramps each having first and second surfaces and a weir, the ramps spaced apart from one another with the weir positioned therebetween, the ramps extending in the lateral direction and contacting each of the side walls, the first surface of the first ramp being adjacent the outlet and inclined downwardly at an angle of 20–50°, the second surface of the first ramp being adjacent the weir and substantially vertical, the first surface of the second ramp being adjacent the weir and inclined downwardly at an angle of 20–50°, the second surface of the second ramp being adjacent the impact area and substantially vertical whereby the surfaces cause molten metal to flow in a direction generally upwardly from the impact area and toward the outlet thereby minimizing entrainment of gas bubbles and slag within molten metal.

13. An elongated tundish for continuous casting molten metal, comprising:

an elongated tundish including a pair of spaced side walls disposed in a longitudinal direction and a pair of spaced end walls extending in a lateral direction between the side walls and a floor, the floor including a molten metal impact area, a molten metal outlet and a ramp having first and second surfaces, the ramp positioned between the impact area and the outlet while extending in the lateral direction, the first surface adjacent the outlet and inclined downwardly at an angle of 20–50°, the second surface facing the impact area and being substantially vertical whereby the surfaces cause molten metal to flow in a direction generally upwardly from the impact area and toward the outlet thereby minimizing entrainment of gas bubbles and slag within molten metal.

14. The tundish of claim 13 wherein the first surface is inclined downwardly at an angle of 30–40°.

15. The tundish of claim 13 wherein the floor includes a weir positioned between the ramp and the impact area.

16. The tundish of claim 15 wherein the floor includes a second ramp positioned between the weir and the impact area, the second ramp including a downwardly inclined surface extending in a direction toward the weir and a vertical surface adjacent to the impact area.

17. The tundish of claim 15 wherein the lowermost elevation of the weir is below the uppermost elevation of the ramp.

18. The tundish of claim 13 wherein the ramp extends completely across the floor and engages each of the side walls.

19. The tundish of claim 15 wherein the vertical surface of the ramp is positioned at least twice as far away from the outlet as the vertical surface of the ramp is positioned away from the weir.

20. The tundish of claim 15 wherein the longitudinal length of the ramp is at least equal to the distance the vertical surface of the ramp is positioned away from the weir.

* * * * *